United States Patent [19]

Kuwabara et al.

[11] 4,219,803

[45] Aug. 26, 1980

[54] TWO-WIRE FIRE SENSING AND RECEIVING SYSTEM

[75] Inventors: Katsutoshi Kuwabara, Yamato; Mitsuo Horiuchi, Sagamihara, both of Japan

[73] Assignee: Hochiki Corporation, Tokyo, Japan

[21] Appl. No.: 919,637

[22] Filed: Jun. 27, 1978

[30] Foreign Application Priority Data

Jul. 4, 1977 [JP] Japan ..... 52-87501[U]

[51] Int. Cl.[2] ..... G08B 17/10; H01H 71/74

[52] U.S. Cl. ..... 340/595; 340/584; 340/630; 323/22 T; 323/22 Z

[58] Field of Search ..... 340/584, 587, 593, 595, 340/596, 600, 628, 629, 630; 323/22 J, 22 Z, 66, 75 E, 75 F, 75 K

[56] References Cited

U.S. PATENT DOCUMENTS

| | | | |
|---|---|---|---|
| 3,214,668 | 10/1965 | Brinster | 323/22 Z X |
| 3,604,960 | 9/1971 | Krestel | 323/22 T X |
| 3,634,839 | 1/1972 | Vassil et al. | 340/630 X |
| 3,678,511 | 7/1972 | Benedict | 340/630 X |
| 3,964,036 | 6/1976 | Adachi et al. | 340/514 |
| 3,979,600 | 9/1976 | Bohning | 323/75 E X |
| 4,041,479 | 8/1977 | Miyabe | 340/629 |
| 4,065,759 | 12/1977 | Handing | 340/630 X |
| 4,100,479 | 7/1978 | Buck | 323/22 Z X |

*Primary Examiner*—John W. Caldwell, Sr.
*Assistant Examiner*—Joseph E. Nowicki
*Attorney, Agent, or Firm*—Jordan and Hamburg

[57] ABSTRACT

A two-wire fire sensing and receiving system having a plurality of fire sensors connected in parallel in which; the difference in current level between a feeding electric current of a relatively small level for controlling the system and a sensing current of a relatively high level for causing the switching element of an alarm device to be conductive is reliably maintained to distinguish their current levels by restraining the current which tends to increase at the beginning of capacitor charging and at intermittent charging periods within the level of the feeding electric current without being affected by the fluctuation in power supply voltage.

8 Claims, 6 Drawing Figures

TWO-WIRE FIRE SENSING AND RECEIVING SYSTEM

DESCRIPTION OF THE PRIOR ART

A conventional two-wire fire sensing-receiving system that was experimentally used consisted of a circuit which includes a constant-voltage circuit as shown in FIG. 1, in which reference numeral 1 represents a receiver, and lines 2*a*, 2*b* for feeding an electric power and signals drawn from said receiver 1 are connected to a sensor 3. The receiver 1 consists of a power supply 4, a resistor $R_1$ connected in series with said line 2*a* for feeding the power supply and signals, a transistor $Q_1$ which will be rendered conductive when the voltage across both terminals of said resistor $R_1$ reach a predetermined value, and an alarm device 5 which will be actuated when said transistor $Q_1$ is rendered conductive. The alarm device 5 is energized when the impedance across lines 2*a* and 2*b* is decreased below a predetermined value. The sensor 3 consists of a switching circuit comprising a thyristor 6, a resistor $R_2$, a constant-voltage circuit composed of a transistor $Q_2$ and a Zener diode $ZD_1$, a capacitor C of large capacity, an oscillator/light emitter 7, and a light-receiving amplifier 8. Electric current from said power supply 4, transmitted via the lines 2*a*, 2*b*, is limited by a high resistance $R_3$ and charges the capacitor C via the constant-voltage circuit, and discharge current from the capacitor C is supplied to a detector circuit. The detector circuit detects by means of the light-receiving amplifier the attenuation of light caused by the presence of smoke, etc., said light being intermittently emitted from said oscillator/light emitter 7. The light-receiving amplifier 8, which detects such attenuation, applies d-c voltage to a gate terminal of said thyristor 6 to render it conductive, such that the impedance across said lines 2*a*, 2*b* is reduced. Further, to reduce the consumption of power under the monitoring state, the light is intermittently emitted by the oscillator/light emitter 7. The consumption of electric power becomes intermittently great due to the intermittent emission of light. Therefore, if the current is directly drawn from the power supply 4 during such periods of great power consumption, a sufficient electric current may flow to said resistor $R_1$ to cause the alarm device 5 to be energized. To eliminate this inconvenience, the electric power is fed from the power supply to said detector circuit via capacitor C, and further the high resistance $R_3$ is used to prevent heavy current from flowing from the power supply 4 to capacitor C and to the detector circuit 3.

In the aforesaid fire sensing and receiving system experimentally used with a power supply voltage of 24 volts±20%, the resistance $R_3$ was selected to be 60 kiloohms to restrain the maximum current which flows into the capacitor C of 200 $\mu$F at the time of closing the power supply to be not greater than 180 $\mu$A, and the Zener diode $ZD_1$ was set to operate at 13 volts in order to maintain the operation voltage needed for the detector circuit 3. The sum of a voltage drop of 11 volts caused by the resistance $R_3$ (60 kiloohms) and the operation voltage of 13 volts of Zener diode $ZD_1$, is equal to the rated power supply voltage of 24 volts. An electric current of 40 $\mu$A is fed to the detector circuit 3 that serves as a load having a resistance of 300 kiloohms. At this time, the voltage drop caused by the high resistance $R_3$ (60 kiloohms) is 2.4 volts; the sum of 2.4 volts and 13 volts, i.e., 15.4 volts, sufficiently approaches the minimum power supply voltage of 19.2 volts. There are 10 sensing devices in the above conventional system which are in such an operation state. Therefore, taking the voltage drop caused by the high resistance $R_3$ into consideration, it is impossible to connect more than 10 sensing devices.

In this way, if the value of the high resistance $R_3$ is increased, the charging voltage to the capacitor C becomes small, i.e., the power supply voltage to the detector circuit becomes small, making it difficult to reliably operate said detector circuit. Since there is imposed a limitation in increasing the value of the high resistance $R_3$, it becomes desirable to provide a circuit which does not employ the high resistance $R_3$.

SUMMARY OF THE INVENTION

An object of the present, invention therefore, is to provide a two-wire fire sensing and receiving system which works on a feeding current of a relatively small level used for charging a capacitor coupled to a sensing device that will be operated by the discharging current of said capacitor, and a sensing current of a relatively large current level which actuates a switching element for energizing a fire alarming device, wherein an overcurrent at the time of closing the power supply that tends to increase with the increased number of capacitors as a result of the employment of an increased number of sensing devices, is restrained to be sufficiently smaller than said sensing current of high level, and the electric current fed to the capacitors that decreases with the increased number of capacitors is maintained to be greater than a value necessary for reliably charging said capacitors within a limited period of charging time, so that the upper limit and the lower limit of the currents are controlled.

Another object of the present invention is to provide a two-wire fire sensing and receiving system in which the upper limit of the feeding current is effectively determined by a resistor having a resistance 1/10 to 1/20 that of the high resistance that was previously used to limit the feeding current, and the drop of the power supply voltage to the detector circuit for energizing the sensing devices is substantially avoided.

A further object of the present invention is to provide a two-wire fire sensing and receiving system having increased number of fire sensing devices composed of said detector circuit, that are connected in parallel with the two-wire circuit for feeding electric current and receiving signals, said two-wire circuit being drawn from a d-c power supply, by minimizing the voltage drop that would develop over the circuit from the d-c power supply to the detector circuits which include a capacitor to actuate the sinsing devices, and permitting the charging current to the capacitor to be increased as compared to prior art circuits.

In designing the fire sensing devices that are connected in parallel with the long two-wire feeder lines extended from the d-c power supply accomodated in the receiving device, it could be easily conceived to use a constant-voltage circuit to charge the capacitor the discharging current of which drives the fire sensor contained in the sensing device. However, any increase in the number of fire sensing devices is accompanied by an increase in the number of capacitors that serve as loads to the power supply. With the two-wire systems which utilize two current levels that can be distinguished by a relatively large level and a relatively small level, however, these levels would become difficult to distinguished with the increased number of capacitors. Or if some means is provided to avoid the confusion of the levels, the output of the constant-voltage circuit will be decreased and will fail to provide an operation voltage necessary for the fire sensing devices.

FIG. 6 shows the relationship between a terminal voltage Vc of the capacitor C, a feeding current $I_1$ and a discharging current $I_2$, according to an embodiment of the present invention shown in FIG. 2. From FIG. 6, it will be understood that a constant-voltage circuit which has the function of controlling the current that will be discussed later, and the capacitor C, are effectively coupled together.

The present invention therefore is related to a two-wire fire sensing and receiving system having a switching element connected across the lines drawn from a receiver for feeding an electric current and signals, said switching element giving a relatively high impedance across said lines under normal condition and being capable of electrically communicating said two lines with a low impedance when fire has broken thereby to produce fire signals, and having a fire sensing device with a capacitor which will store the energy of said feeding current. A low resistance is inserted in series with one of said two lines. The switching element is connected across said lines via said low resistance on the side of said receiver. The capacitor is connected across said two lines on the side of a detector. A constant-voltage circuit comprising a transistor, a resistor and a Zener diode is connected across the two lines on a side closer to the receiver than said capacitor. A by-pass circuit which will be operated when a voltage drop across said low resistance reaches a predetermined value is connected between a control electrode of the transistor of the constant-voltage circuit and one of the two lines.

DETAILED DESCRIPTION OF THE PREFERRED EMBODIMENTS

An embodiment of the present invention is illustrated below in detail with reference to FIG. 2.

Figure 1:
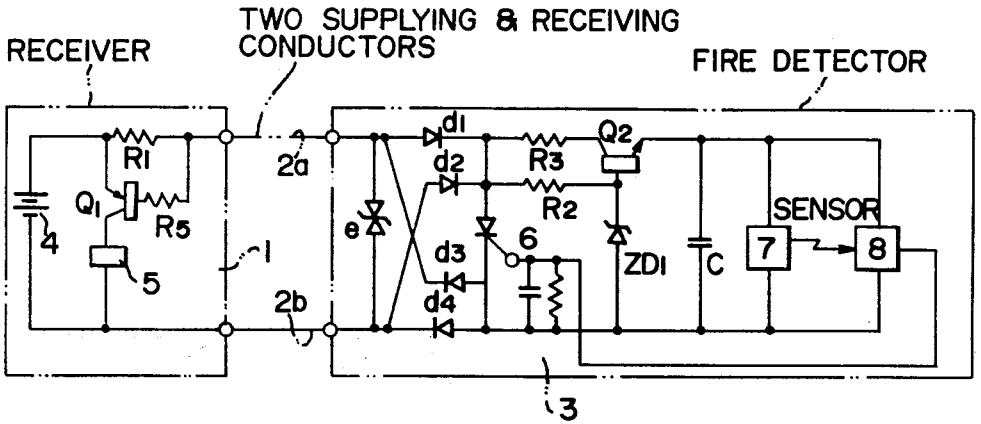
FIG. 1 Prior Art
FIG. 1 is a circuit diagram showing a conventional setup of the prior art.
Figure 2:
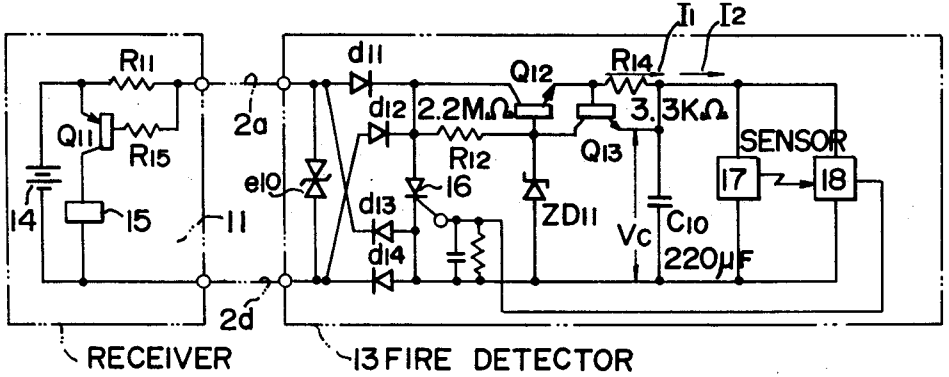
FIG. 2 is a circuit diagram showing an embodiment according to the present invention.

A positive terminal of a d-c power supply 14, FIG. 2, having a voltage of 24 volts±4.8 volts is connected to an emitter of a transistor $Q_{11}$ and to a resistor $R_{11}$, and the other terminal of the resistor $R_{11}$ is connected to an output terminal of a receiver 11. To the output terminal of the receiver 11 is connected a resistor $R_{15}$, and the other terminal of the resistor $R_{15}$ is connected to a base of the transistor $Q_{11}$. A collector of the transistor $Q_{11}$ is connected to one terminal of an alarm device 15, and the other end of the alarm device 15 is connected to the negative terminal of the power supply 14 and to the other output terminal of the receiver 11. An electric current of 1 mA to 20 mA flowing through the resistor $R_{11}$ is sufficient to render the transistor $Q_{11}$ conductive. The receiver 11 is composed of the resistor $R_{11}$, the resistor $R_{15}$, the transistor $Q_{11}$, the alarm device 15, and the power supply 14.

One input terminal of a sensing device 13 is connected to a diode $d_{11}$, a diode $d_{13}$ and a bidirectional Zener diode $e_{10}$, and other input terminal of the sensing device 13 is connected to a diode $d_{12}$, a diode $d_{14}$ and to the other terminal of the bidirectional Zener diode $e_{10}$. The other terminal of the diode $d_{11}$ and the other terminal of the diode $d_{12}$ are connected to a collector of a transistor $Q_{12}$, a resistor $R_{12}$ (2.2 megohms) and to a thyristor 16. The other terminal of the resistor $R_{12}$ is connected to a Zener diode $ZD_{11}$, to a base of the transistor $Q_{12}$ and to a collector of a transistor $Q_{13}$. The emitter of the transistor $Q_{12}$ is connected to the base of the transistor $Q_{13}$ and to a resistor $R_{14}$ (3.3 kiloohms). The other end of the resistor $R_{14}$ is connected to a capacitor $C_{10}$ (220 $\mu$F), to a positive terminal which is a power-supply input terminal of an oscillator/light emitter 17, to a positive terminal which is a power-supply input terminal of a light-receiving amplifier 18, and to an emitter of the transistor $Q_{13}$. The other terminal of the diode $d_{13}$ and the other terminal of the diode $d_{14}$ are connected to the other terminal of the thyristor 16, to the other terminal of the Zener diode $ZD_{11}$, to the other terminal of the capacitor $C_{10}$, to a negative terminal which is a power-supply input terminal of the oscillator/light emitter 17, and to a negative terminal which is a power-supply input terminal of the light-receiving amplifier 18. An alarm signal output terminal of the light-receiving amplifier 18 is connected to a gate terminal of the thyristor 16. The sensing device 13 is composed of diodes $d_{11}$, $d_{12}$, $d_{13}$, $d_{14}$, bidirectional Zener diode $e_{10}$, resistors $R_{12}$ and $R_{14}$, transistors $Q_{12}$ and $Q_{13}$, the capacitor $C_{10}$, the Zener diode $ZD_{11}$, the thyristor 16, the oscillator/light emitter 17, and the light-receiving amplifier 18. The two output terminals of the receiver 11 and the two input terminals of the sensing device 13 are connected together by means of two wires 2*a* and 2*b* for feeding electric current and signals.

The diodes $d_{11}$, $d_{12}$, $d_{13}$ and $d_{14}$ are so connected that a proper voltage is applied to the sensing device 13 whichever output terminals of the receiver 11 are connected to the input terminals of the sensing device 13, and the bidirectional Zener diode $e_{10}$ prevents the application of overvoltage to the sensing device 13.

When an electric current flowing through the resistor $R_{14}$ is small, the potential across the resistor $R_{14}$ is small, i.e., the voltage is small across the base and the emitter of the transistor $Q_{13}$, and the circuit across the collector and the emitter of the transistor $Q_{13}$ is great, i.e., open. Therefore, since the value of the resistor $R_{14}$ is sufficiently small, the constant-voltage circuit composed of the transistors $Q_{12}$ and $Q_{13}$, resistors $R_{12}$ and $R_{14}$ and Zener diode $ZD_{11}$, maintains the potential constant across the terminals of the capacitor $C_{10}$. If the electric current flowing through the resistor $R_{14}$ increases, and the potential across the resistor $R_{14}$, i.e., the potential across the base and the emitter of the transistor $Q_{13}$ reaches a predetermined value $V_{BE}$ at which the base current of the transistor $Q_{13}$ starts to flow, the circuit across the collector and the emitter of the transistor $Q_{13}$ which had been of a great resistance acquires a small resistance, whereby the current corresponding to the base current of the transistor $Q_{12}$ that would have been increased flows across the collector and the emitter of the transistor $Q_{13}$, so that the base current of the transistor $Q_{12}$ will not increase above a predetermined value. Therefore, the collector current of the transistor $Q_{12}$ does not increase above a predetermined value. The predetermined value of the collector current of the transistor $Q_{12}$ is given by the ratio of a voltage across the base and emitter of the transistor $Q_{13}$ at a moment when the base current of the transistor $Q_{13}$ starts to flow to the resistance $R_{14}$. For example, let it be supposed that a maximum current of about 180 $\mu$A is supplied to a circuit having a load resistance of 300 kiloohms and a capacitance C of 220 $\mu$F that are connected in parallel, the control voltage of the Zener diode $ZD_{11}$ is set at 13 volts, the resistance $R_{12}$ is selected to be 22 megohms, the voltage $V_{BE}$ across the base and the emitter of the transistor $Q_{13}$ at a moment when the base current of the transistor $Q_{13}$ starts to flow is 0.6 volt, and the resistance $R_{14}$ is selected to be 3.3 kiloohms. In such case, an electric current of about 40 $\mu$A will flow through the resistor $R_{14}$; the current greater than 180 $\mu$A is not allowed to flow through the resistor $R_{14}$. The voltage drop across the resistor $R_{14}$ caused by a current of 40 $\mu$A is about 0.132 volt. Therefore, the lower limit of the effective range of the power-supply voltage according to this embodiment can be expanded to about 13.132 volts.

The oscillator/light emitter emits the light, usually, maintaining an interval of 2.5 to 3.5 seconds; an electric current of 200 mA will be consumed for a light-emitting duration of about 300 $\mu$sec. The aforementioned circuit according to an embodiment of the present invention enables the number of fire sensing devices to be increased by 50% to 100% as compared to the conventional test circuit mentioned earlier.

Figure 3:
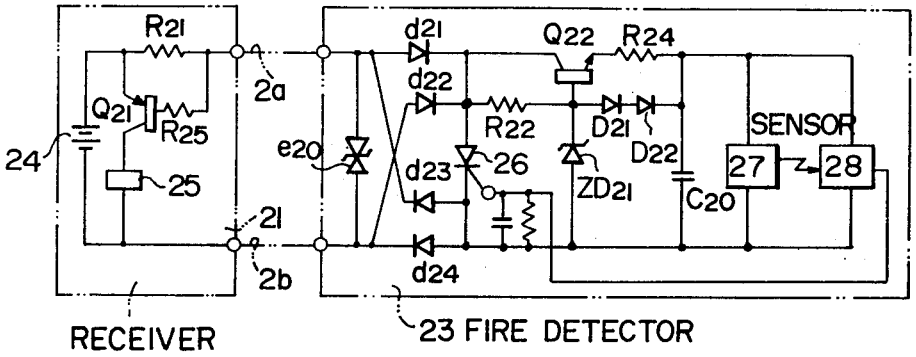
FIG. 3 to FIG. 5 are circuit diagrams showing other embodiments according to the present invention.

FIG. 3 shows another embodiment according to the present invention. In this embodiment, a direct coupling of diodes $D_{21}$ and $D_{22}$ is connected between the base of the transistor $Q_{22}$ and the capacitor $C_{20}$ in place of the transistor $Q_{13}$ that was used in the embodiment of FIG. 2. The direct coupling of diodes $D_{21}$ and $D_{22}$ serves as a Zener diode; the potential across the terminals of a circuit composed of the direct coupling of diodes $D_{21}$ and $D_{22}$ is maintained within a predetermined value. As a result, the base current of the transistor $Q_{22}$ is limited within a predetermined value, and the collector current of the transistor $Q_{22}$ is limited within a predetermined value. Thus, the circuit composed of a transistor $Q_{22}$, resistors $R_{22}$ and $R_{24}$, Zener diode $ZD_{21}$ and diodes $D_{21}$ and $D_{22}$ works as a constant-voltage circuit when the electric current flowing into the resistor $R_{24}$ is smaller than a predetermined value, and further serves as a current limiter circuit which does not permit an electric current above a predetermined value to flow into the resistor $R_{24}$. Therefore, this embodiment works in the same manner as the embodiment illustrated with reference to FIG. 2.

Figure 4:
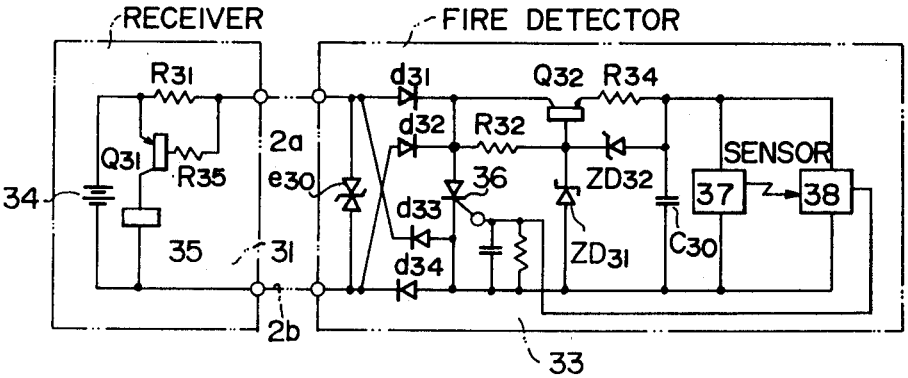

FIG. 4 shows a further embodiment according to the present invention. This embodiment employs a Zener diode $ZD_{32}$ in place of the direct coupling of diodes $D_{21}$ and $D_{22}$ that serves as a Zener diode used in the embodiment of FIG. 3. Therefore, this embodiment works in the same manner as the embodiment of FIG. 3.

Figure 5:
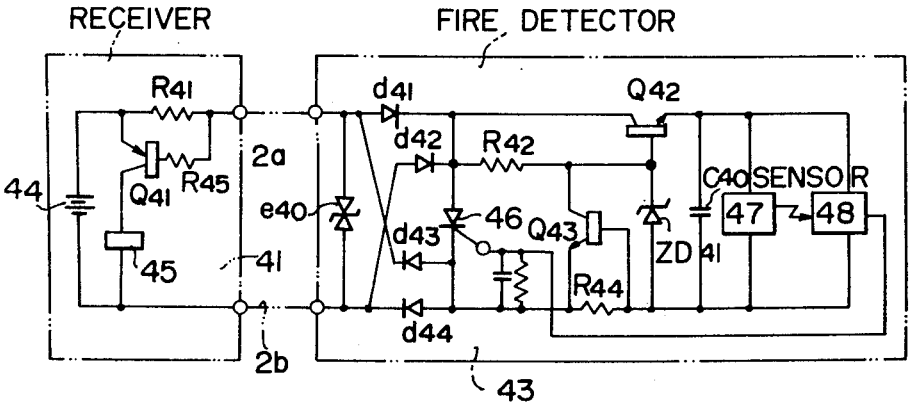
Figure 6:
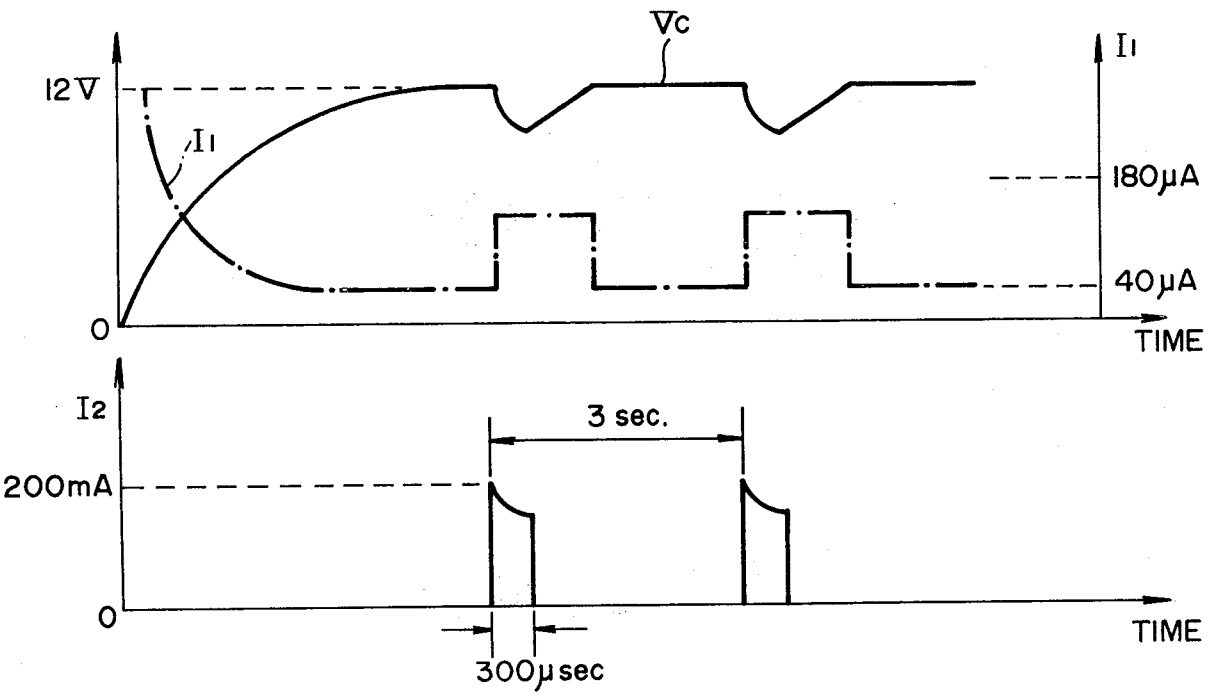
FIG. 6 is a chart showing relationships between a voltage of a capacitor, a feeding electric current and a discharging current.

FIG. 5 shows a still further embodiment according to the present invention. In this embodiment, the base and emitter of the transistor $Q_{13}$ and the resistor $R_{14}$ of the embodiment of FIG. 2 are all connected to the line of negative polarity as represented by the base and emitter of a transistor $Q_{43}$ and a resistor $R_{44}$. In this case, if attention is given to the direction of current flowing in the resistor $R_{14}$ of the embodiment of FIG. 2 and to the direction of the current flowing in the resistor $R_{44}$, it will be understood that the position of base and emitter of the transistor $Q_{13}$ with respect to the resistor $R_{14}$ of the embodiment of FIG. 2 is relatively equal to the position of base and emitter of the transistor $Q_{43}$ with respect to the resistor $R_{44}$. Accordingly, this embodiment works in the same manner as the embodiment of FIG. 2.

When ionic sensing devices are to be used in place of the photoelectric sensing devices, the operation conditions of each of the elements have to be corrected depending upon the values of load resistances.

What is claimed is:

1. A two-wire fire sensing and receiving system comprising;

a plurality of sensing devices comprising a capacitor, a fire sensor connected between the terminals of said capacitor and which is operated by discharging current of said capacitor to produce fire signals, and a terminal short-circuiting line including a switching means which is rendered conductive by the application of such fire signals;

a receiving device comprising a d-c power supply, a first switching element connected in series, in a short-circuiting trunk line connected between the positive terminal and the negative terminal of the power supply, with an alarm control device;

a two-wire circuit extending from the positive and negative terminals of said short-circuiting trunk line, said switching means comprising a second switching element the positive and negative terminals of the terminal short-circuiting line of the second switching element of each of the sensing devices being connected thereto, such that said sensing devices and said receiving device are coupled together;

a transistor connected between the positive terminal of said capacitor and a positive terminal of said terminal short-circuiting line, a Zener diode connected between the control electrode terminal of the transistor and a negative terminal of said capacitor, and a detector resistance included in either the circuit between the output terminal of said transistor and the positive terminal of said capacitor or the circuit between the negative terminal of said Zener diode and the negative terminal of said terminal short-circuiting line, wherein a voltage differential is created by an electric current flowing through said detector resistance; and by-pass means of which one terminal is connected to the control electrode terminal of said transistor and of which the other terminal is connected to a low-potential terminal of said current detector resistance, such that the potential to said control electrode is varied in dependence on a predetermined potential difference across the two terminals of said current detector resistance;

wherein the electrical current fed from the d-c power supply is controlled to be not greater than a current which is necessary for driving said fire sensors and which is determined by said current detector resistance incorporated in said by-pass means.

2. A two-wire fire sensing and receiving system according to claim 1, wherein said by-pass means comprises a second transistor having a control electrode terminal that is connected to a high-potential terminal of said current detector resistance in the output circuit of said first mentioned transistor, and of which the other terminals are connected between the control electrode terminal of the first mentioned transistor and the low-potential terminal of said current detector resistor, such that said second transistor is operated by a potential difference determined by said current detector resistance.

3. A two-wire fire sensing and receiving system according to claim 1, wherein said by-pass means is composed of a diode connected between the low-potential terminal of said current detector resistance contained in the output circuit of said transistor and the control electrode terminal of said transistor, such that said diode is rendered conductive by the potential difference determined by said current detector resistance.

4. A two-wire fire sensing and receiving system according to claim 1, wherein said by-pass means is composed of a Zener diode connected between the low-potential terminal of said current detector resistance contained in the output circuit of said transistor and the control electrode terminal of said transistor, such that said Zener diode is rendered conductive by the potential difference determined by said current detector resistance.

5. A two-wire fire sensing and receiving system according to claim 1, wherein said by-pass means is composed of a second transistor comprising a control electrode terminal that is connected to the high-potential terminal of said current detector resistance contained in the circuit between the negative terminal of said Zener diode connected to the control electrode terminal of said first mentioned transistor and the negative terminal of said terminal short-circuiting line, and of which other terminals are connected between a gate of said Zener diode and the low-potential terminal of said current detector resistance, such that said second transistor is operated by the potential difference determined by said current detector resistance.

6. The two-wire fire sensing and receiving system of claim 1, wherein said transistor and by-pass means comprise the sole charging paths for said capacitor.

7. The two-wire fire sensing and receiving system of claim 1, wherein said second switching element comprises an SCR having a gate electrode coupled to said fire sensor.

8. The two-wire fire sensing and receiving system of claim 1, wherein said fire sensors comprise an oscillator/light emitter and a light-receiving amplifier coupled to receive light from said light emitter.

* * * * *